US007780375B1

(12) United States Patent
Khachaturian et al.

(10) Patent No.: US 7,780,375 B1
(45) Date of Patent: Aug. 24, 2010

(54) METHOD AND APPARATUS FOR ELEVATING A MARINE PLATFORM

(76) Inventors: Jon Khachaturian, 11903 FM 529, Houston, TX (US) 77041; E. John Greeves, 5406 John Dreaper Dr., Houston, TX (US) 77056

( * ) Notice: Subject to any disclaimer, the term of this patent is extended or adjusted under 35 U.S.C. 154(b) by 317 days.

(21) Appl. No.: 11/749,587

(22) Filed: May 16, 2007

Related U.S. Application Data

(60) Provisional application No. 60/824,005, filed on Aug. 30, 2006.

(51) Int. Cl.
*E02B 17/08* (2006.01)

(52) U.S. Cl. ..... 405/196; 405/211

(58) Field of Classification Search ..... 405/196, 405/197, 204, 211
See application file for complete search history.

(56) References Cited

U.S. PATENT DOCUMENTS 4,678,372 A * 7/1987 Cousty ..... 405/196
4,799,829 A * 1/1989 Kenny ..... 405/195.1
5,445,476 A * 8/1995 Sgouros et al. ..... 405/224
5,741,089 A * 4/1998 Gallaher et al. ..... 405/196
6,668,746 B1 * 12/2003 Schia et al. ..... 114/264
6,736,571 B2 * 5/2004 McCarthy et al. ..... 405/209
6,840,713 B1 * 1/2005 Schia et al. ..... 405/209
2003/0108392 A1 * 6/2003 McCarthy et al. ..... 405/196

* cited by examiner

*Primary Examiner*—Frederick L Lagman
(74) *Attorney, Agent, or Firm*—Garvey, Smith, Nehrbass & North, L.L.C.; Charles C. Garvey, Jr.

(57) ABSTRACT

A method of elevating the deck area of a marine platform (e.g. oil and gas well drilling or production platform) utilizes a specially configured sleeve support to support the platform legs so that they can be cut. Once cut, jacks elevate the platform above the cuts. The sleeve support is then connected (e.g. welded) to the platform leg and becomes part of the structural support for the platform.

39 Claims, 9 Drawing Sheets

METHOD AND APPARATUS FOR ELEVATING A MARINE PLATFORM

CROSS-REFERENCE TO RELATED APPLICATIONS

Priority of U.S. Provisional Patent Application Ser. No. 60/824,005, filed Aug. 30, 2006, incorporated herein by reference, is hereby claimed.

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

1. Field of the Invention

The present invention relates to marine platforms such as oil and gas well drilling platforms. More particularly, the present invention relates to an improved method and apparatus for elevating the deck area of a fixed marine platform to better protect equipment that is located on the deck area from storms (e.g. hurricanes) that generate heightened wave action.

2. General Background of the Invention

There are many fixed platforms located in the oil and gas well drilling areas off the United States coast such as in the Gulf of Mexico. Such marine platforms typically employ an undersea support structure that is commonly referred to as a jacket. These jackets can be many hundreds of feet tall, being sized to extend between the seabed and the water surface area. Jackets are typically constructed of a truss like network of typically cylindrically shaped pipe, conduit or tubing that is welded together. The jackets can be secured to the seabed using pilings that are driven into the seabed. The jacket is then secured to the piling. The part of the offshore marine platform that extends above the jacket and above the water surface is typically manufactured on shore and placed upon the jacket using known lifting equipment such as a derrick barge. This upper portion is the working part of the platform that is inhabited by workers.

Marine platforms can be used to perform any number of functions that are associated typically with the oil and gas well drilling and production industry. Such platforms can be used to drill for oil and gas. Such platforms can also be used to produce wells that have been drilled. These fixed platforms typically provide a deck area that can be crowded with extensive equipment that is used for the drilling and/or production of oil and gas.

When storms strike the Gulf of Mexico and other areas, offshore marine platforms are put at risk. While the jacket and platform are typically designed to resist hurricane force wind and wave action, equipment located on the deck of the marine platform can easily be damaged if hurricane generated wave action reaches the deck area.

An additional consequence of wave action reaching the platform deck is catastrophic platform collapse, which happened in several instances during recent storms in the United States Gulf of Mexico.

BRIEF SUMMARY OF THE INVENTION

The present invention solves these prior art problems and shortcomings by providing a method and apparatus for elevating the deck area of an existing marine platform so that equipment that occupies the deck can be further distanced from the water surface. The method of the present invention this provides more clearance, more freeboard and more protection to deck area equipment during severe storms such as hurricanes.

BRIEF DESCRIPTION OF THE SEVERAL VIEWS OF THE DRAWINGS

For a further understanding of the nature, objects, and advantages of the present invention, reference should be had to the following detailed description, read in conjunction with the following drawings, wherein like reference numerals denote like elements and wherein.

DETAILED DESCRIPTION OF THE INVENTION

Figure 13:
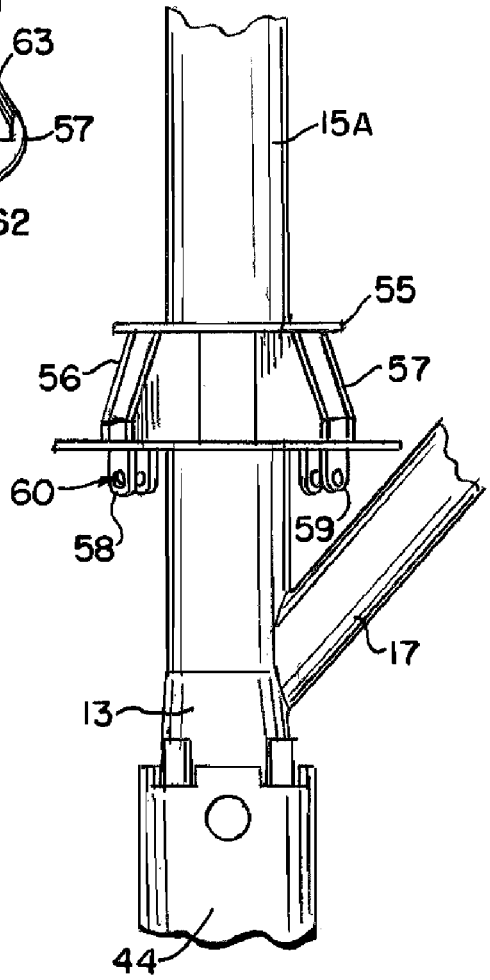
FIG. 13 is a partial elevation view of the preferred embodiment of the apparatus of the present invention illustrating placement of the upper ring.
Figure 14:
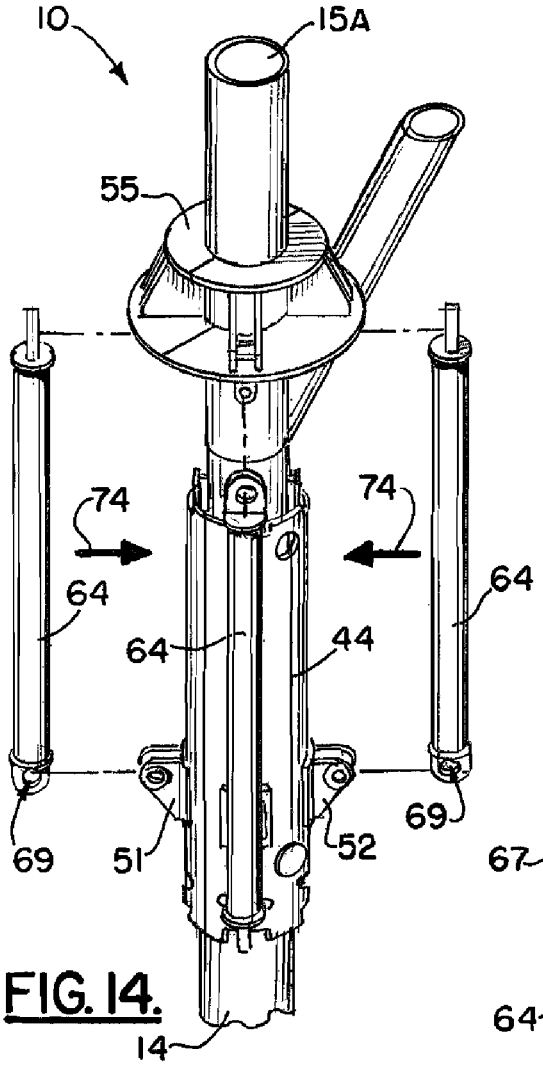
FIG. 14 is a partial perspective exploded view of the preferred embodiment of the apparatus of the present invention illustrating placement of the hydraulic pistons.
Figure 16:
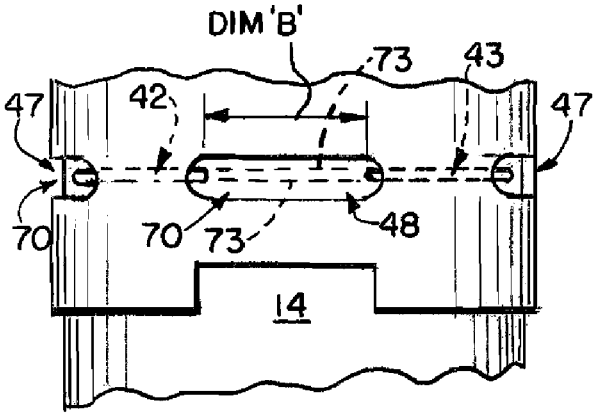
FIG. 16 is a fragmentary elevation view illustrating the method of the present invention, namely the step of completing the leg cuts.
Figure 15:
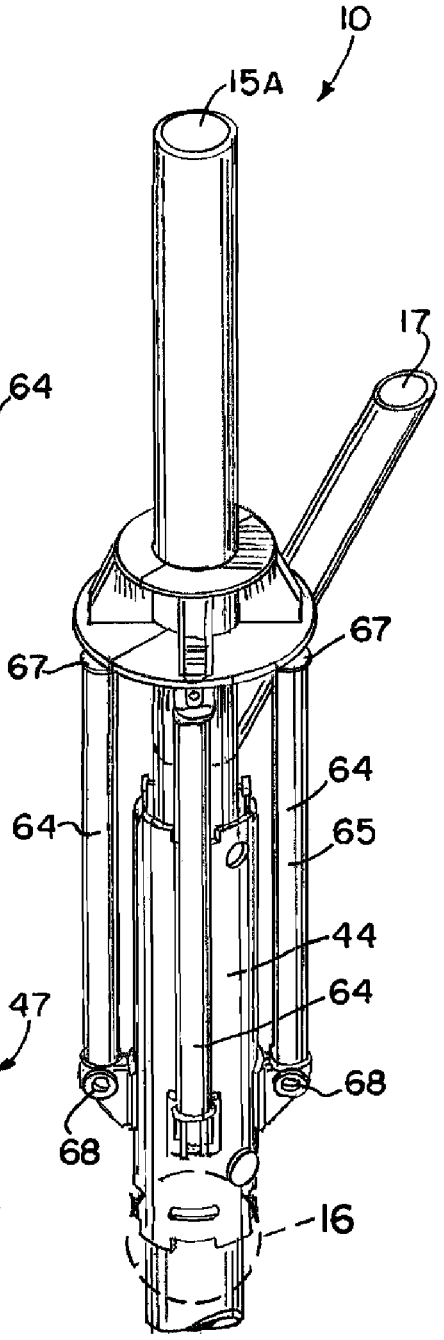
FIG. 15 is a partial perspective view of the preferred embodiment of the apparatus of the present invention illustrating placement of the hydraulic pistons.
Figure 17:
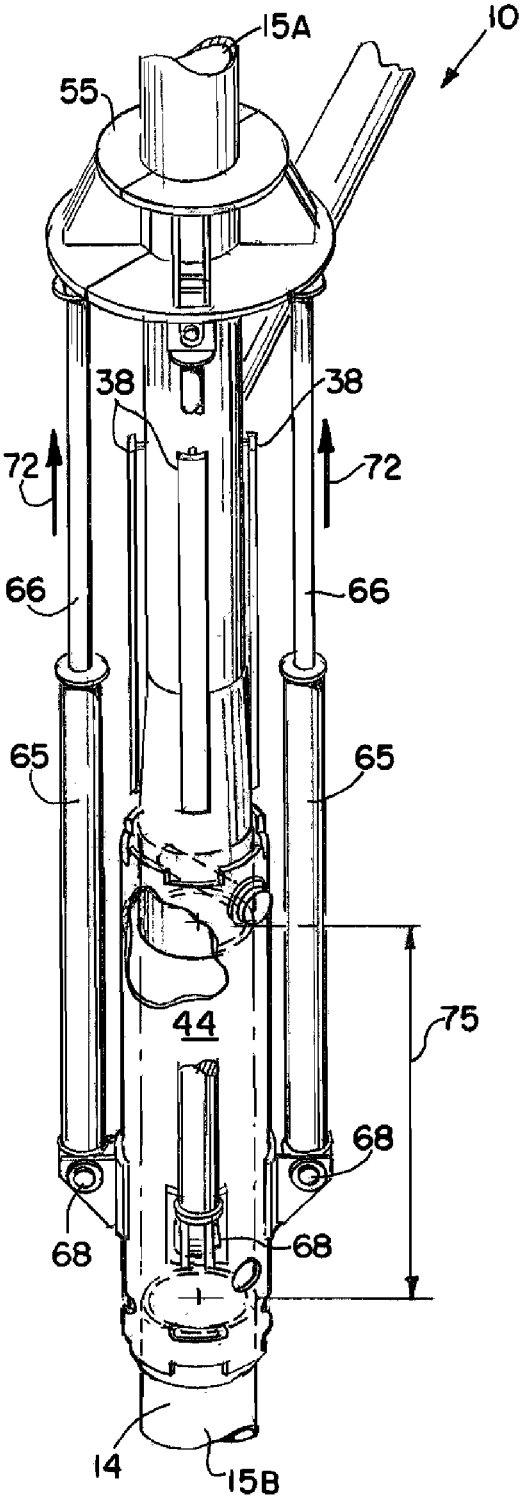
FIG. 17 is a fragmentary perspective of the preferred embodiment of the apparatus of the present invention illustrating extension of the leg with the hydraulics pistons.
Figure 18:
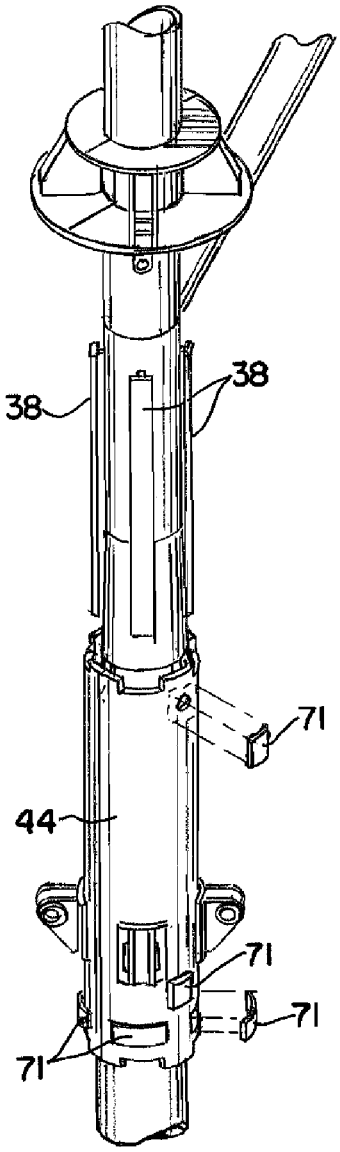
FIG. 18 is a partial perspective view of the method and apparatus of the present invention, showing the method step of closing the sleeve openings.

The present invention provides a marine platform deck elevating system 10 that is shown generally in FIGS. 14-15 and 17 and in method steps that are illustrated in FIGS. 2-18.

Figure 1:
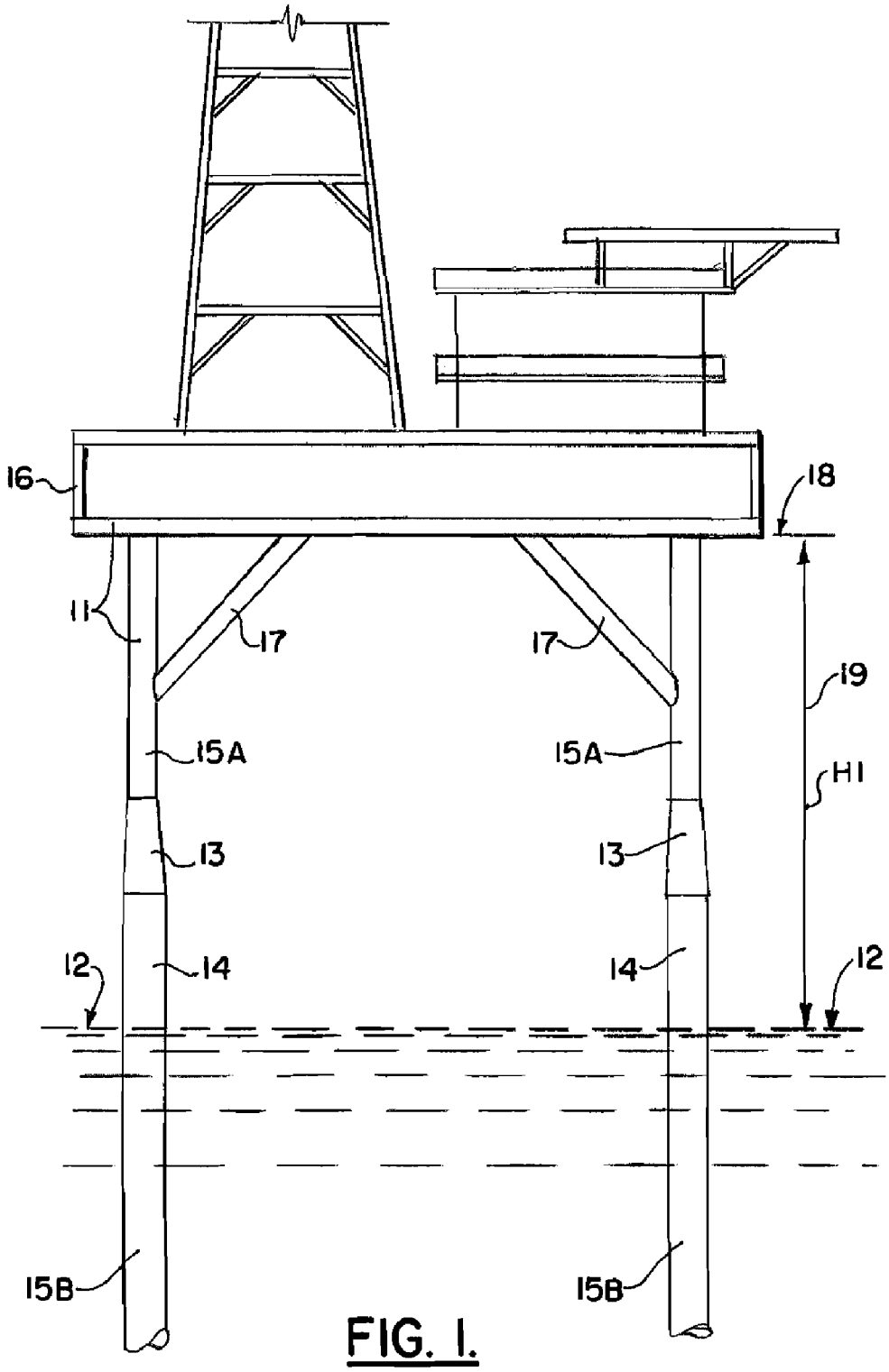
FIG. 1 is a schematic, elevation view of a fixed marine platform.

In FIG. 1, a fixed marine platform 11 is shown having a deck 16 that is positioned at an elevation 18 that is elevated above the water surface 12 a distance H1 that is indicated by the numeral 19 in FIG. 1. The numeral 19 and the dimension line H1 represent the existing clearance above water. It is necessary to protect equipment that is contained on the deck 16 from storm generated wave action. In the Gulf of Mexico, hurricanes can generate a storm surge and wave action that puts equipment and/or personnel located on deck 16 at peril. If a deck is not located at a safe elevation, it must be elevated. FIG. 1 illustrates a typical fixed platform 11 having a plurality of legs 14 that support the deck 16. Diagonal braces 17 can extend between legs 14 and deck 16 as shown in FIG. 1. The platform 11 can include other structure such as for example horizontal beams or members and/or additional vertical or diagonal members.

Figure 19:
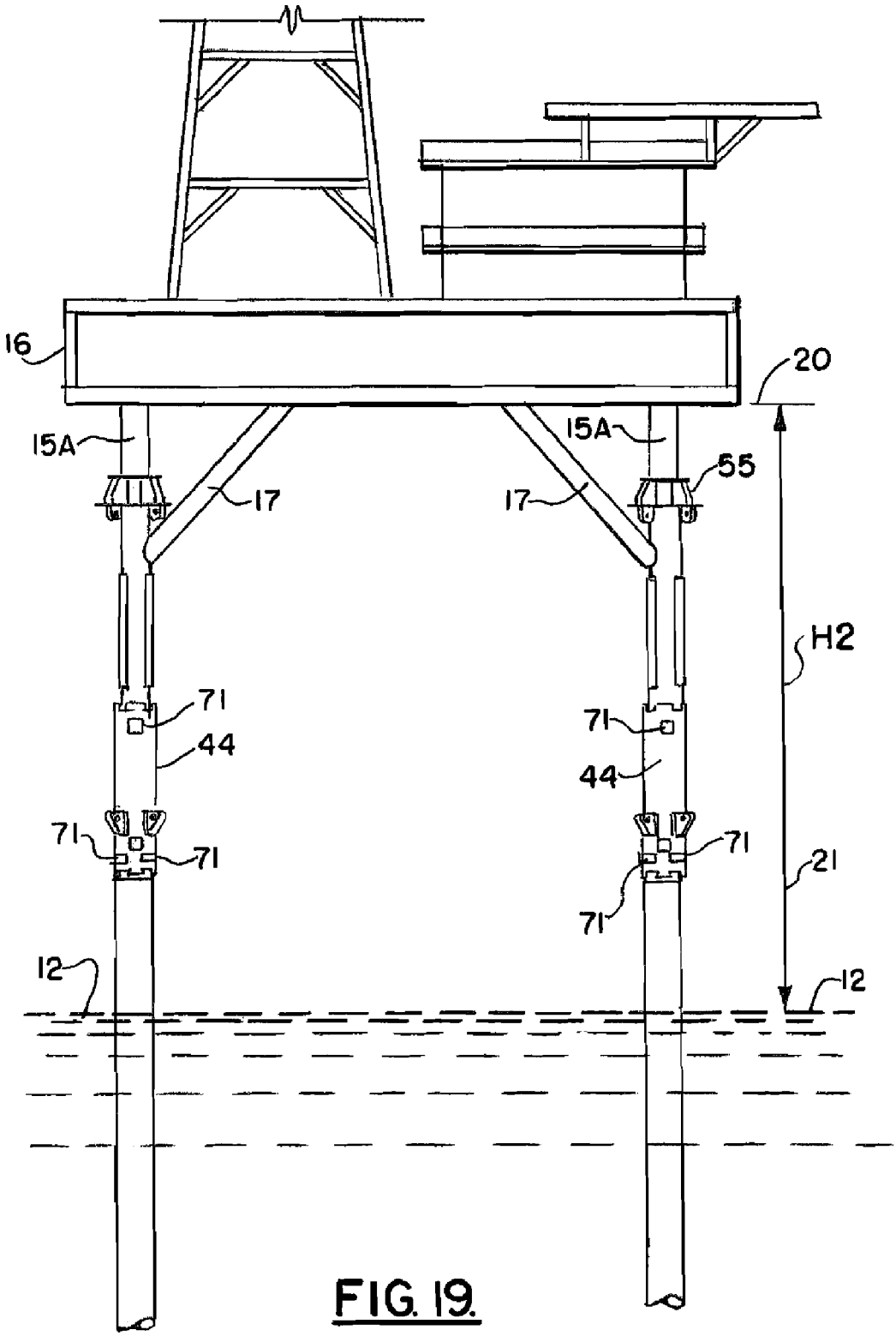
FIG. 19 is an elevation view of the preferred embodiment of the apparatus of the present invention illustrating the marine platform after its deck area has been elevated using the method and apparatus of the present invention.

Legs 14 can be of a constant diameter or can include tapered sections 13, wherein the diameter of the upper leg section 15A is less than the diameter of the lower leg section 15B. Leg 14 can thus include a number of different leg sections such as a lower, larger diameter leg section 15B, a tapered leg section 13, and an upper, smaller diameter leg section 15A that is positioned above the tapered section 13. The method and apparatus of the present invention can be used to elevate the deck 16 to a new elevation 20 (see FIG. 19) that is higher than the previous, existing deck elevation 18 of FIG. 1. The method and apparatus of the present invention thus provides a new clearance 21 above water surface 12 (also shown by the arrow H2 in FIG. 19).

Figure 2:
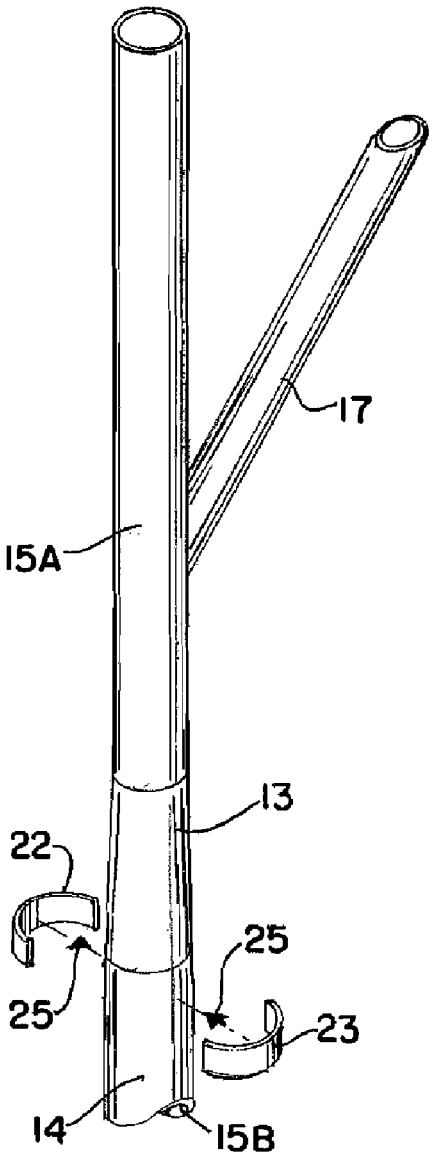
FIG. 2 is a perspective view illustrating a method step of the present invention.
Figure 3:
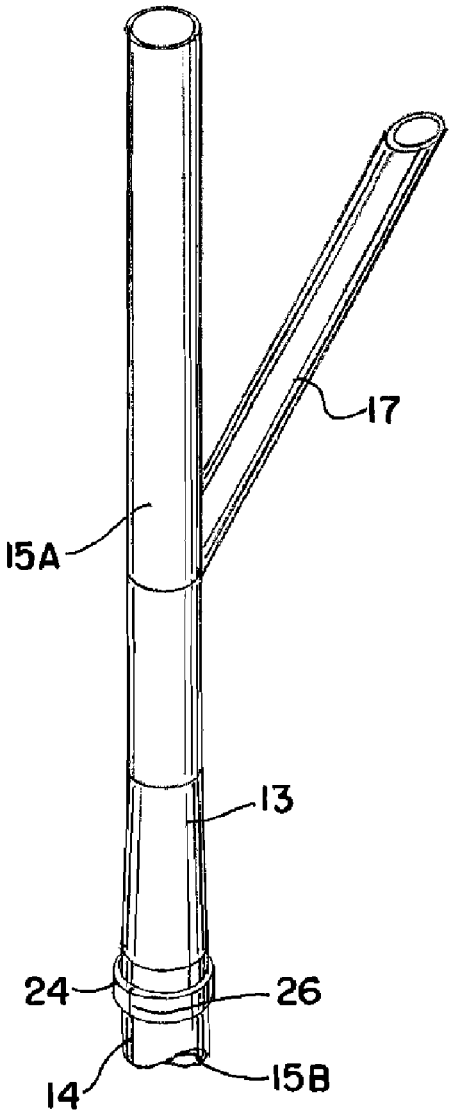
FIG. 3 is a perspective view illustrating a method step of the present invention.
Figure 4:
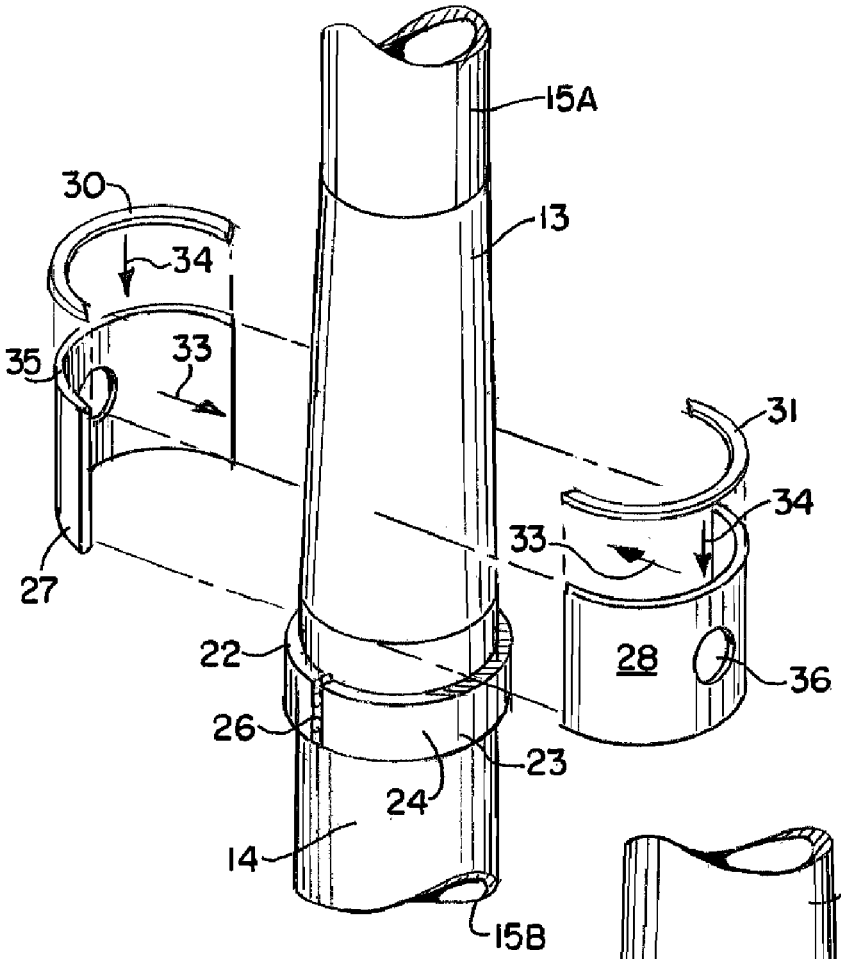
FIG. 4 is a perspective view illustrating a method step of the present invention, placement of the upper and lower bushing sleeves.

FIGS. 2 and 3 illustrate an initial method step of the present invention, namely the placement of lower bushing sleeve 24. The lower bushing sleeve 24 can be comprised of a pair of half sleeve sections 22, 23 as shown in FIGS. 2-3. The sections 22, 23 can be joined with welds 26 as shown in FIGS. 3-4. Arrows 25 in FIG. 2 schematically illustrate the placement of sleeve sections 22, 23 upon leg 14 at a position below tapered section 13 as shown.

Figure 5:
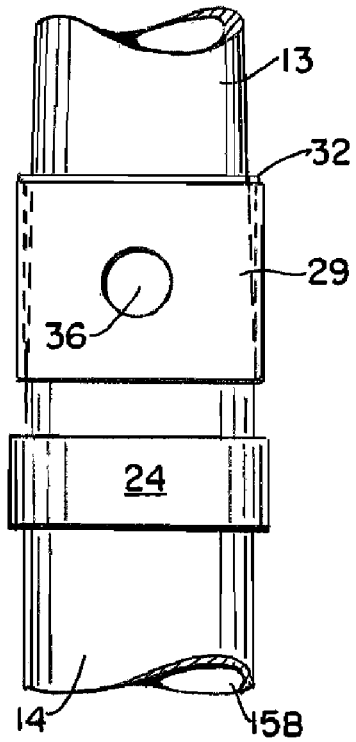
FIG. 5 is a partial perspective view of the preferred embodiment of the apparatus of the present invention illustrating placement of the upper and lower bushing sleeves.
Figure 6:
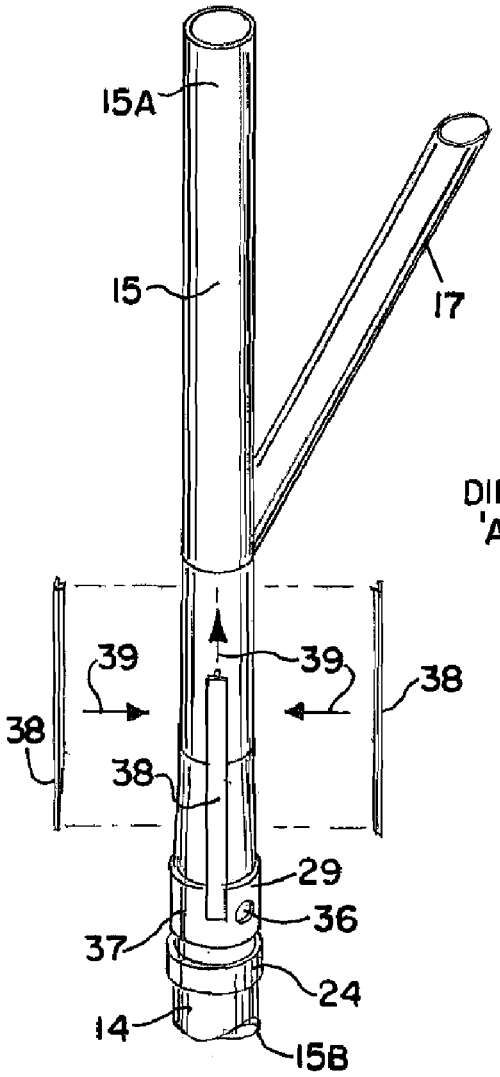
FIG. 6 is a partial perspective view of the preferred embodiment of the apparatus of the present invention illustrating a method step of the present invention.

In FIGS. 4-6, upper bushing sleeve 29 can also be comprised of a pair of sleeve half sections. The sleeve sections 27, 28 each provide an opening 35 or 36 that is receptive of a pin 50 as will be explained more fully hereinafter. Weld ring sections 30, 31 can be used to attach the sleeve sections 27, 28 to tapered section 13. As with the lower bushing sleeve 24, one or more welds 37 can be used to join the sleeve sections 27, 28 to each other. Arrows 33 in FIG. 4 illustrate the placement of sleeve sections 27, 28 upon tapered section 13. Arrows 34 in FIG. 4 illustrate the attachment of weld ring 32 to the assembly of sleeve sections 27, 28 and to tapered section 13.

Figure 7:
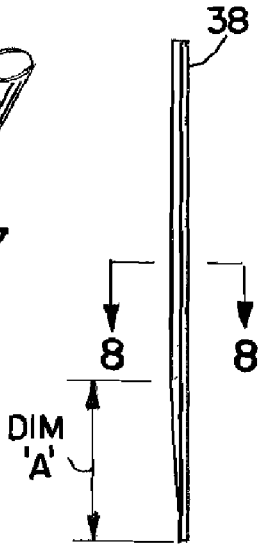
FIG. 7 is a partial perspective view of the preferred embodiment of the apparatus of the present invention illustrating one of the extension sleeve guides.
Figure 8:
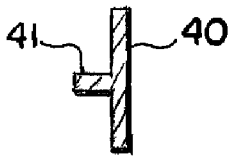
FIG. 8 is a sectional view taken along lines 8-8 of FIG. 7.
Figure 9:
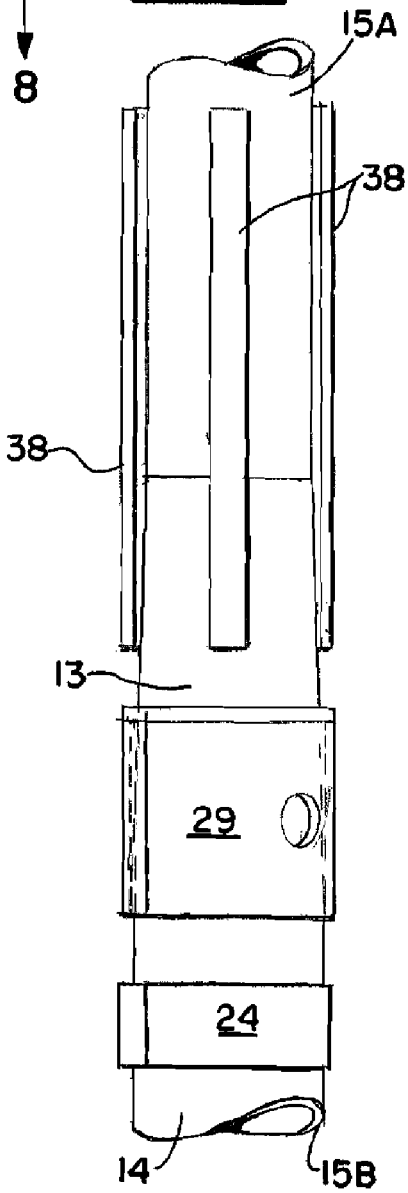
FIG. 9 is a partial elevation view of the preferred embodiment of the apparatus of the present invention illustrating placement of the extension sleeve guides.

In FIGS. 6-9 and 11, a plurality of extension sleeve guides 38 are shown. These extension sleeve guides 38 are attached to the platform 11 leg 14 at a position that is above upper bushing sleeve 29. The extension sleeve guides 38 can extend from tapered section 13 to smaller diameter leg section 15A as shown in FIGS. 6 and 9. Arrows 39 illustrate placement of extension sleeve guides 38 to leg 14. Each extension sleeve 38 can be comprised of flanges 40 and webs 41. The web 41 actually contacts the leg 14 and can be shaped to conform to the shapes of tapered section 13 and smaller diameter leg section 15A as shown in FIGS. 7 and 9 (see DIM "A", FIG. 7).

In FIGS. 10-15, an extension sleeve 44 can be comprised of a pair of extension sleeve sections 45, 46. Each extension sleeve section 45, 46 has slots 47, 48 that can be used to complete a cut through the leg 14 after the sleeve sections 45, 46 have been attached to leg 14 and guides 38.

Figure 10:
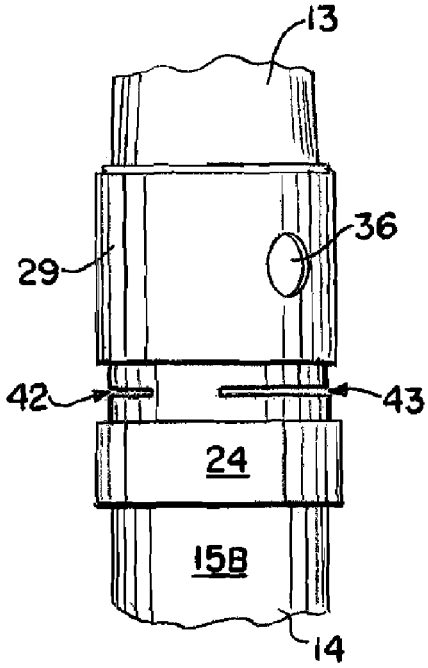
FIG. 10 is a partial elevation view of the preferred embodiment of the apparatus of the present invention showing positions of the leg cuts.

Before attachment of the sleeve sections 45, 46 four cuts are made through leg 14 as shown in FIG. 10. The cuts 42, 43 do not extend 360 degrees around the leg 14, but rather extend only a partial distance as shown in FIG. 10. Though partial cuts 42, 43 are made, enough of the leg 14 remains to structurally support the platform 11 and its deck 16 considering the use of sleeve 44 and the method of the present invention disclosed herein.

Figure 11:
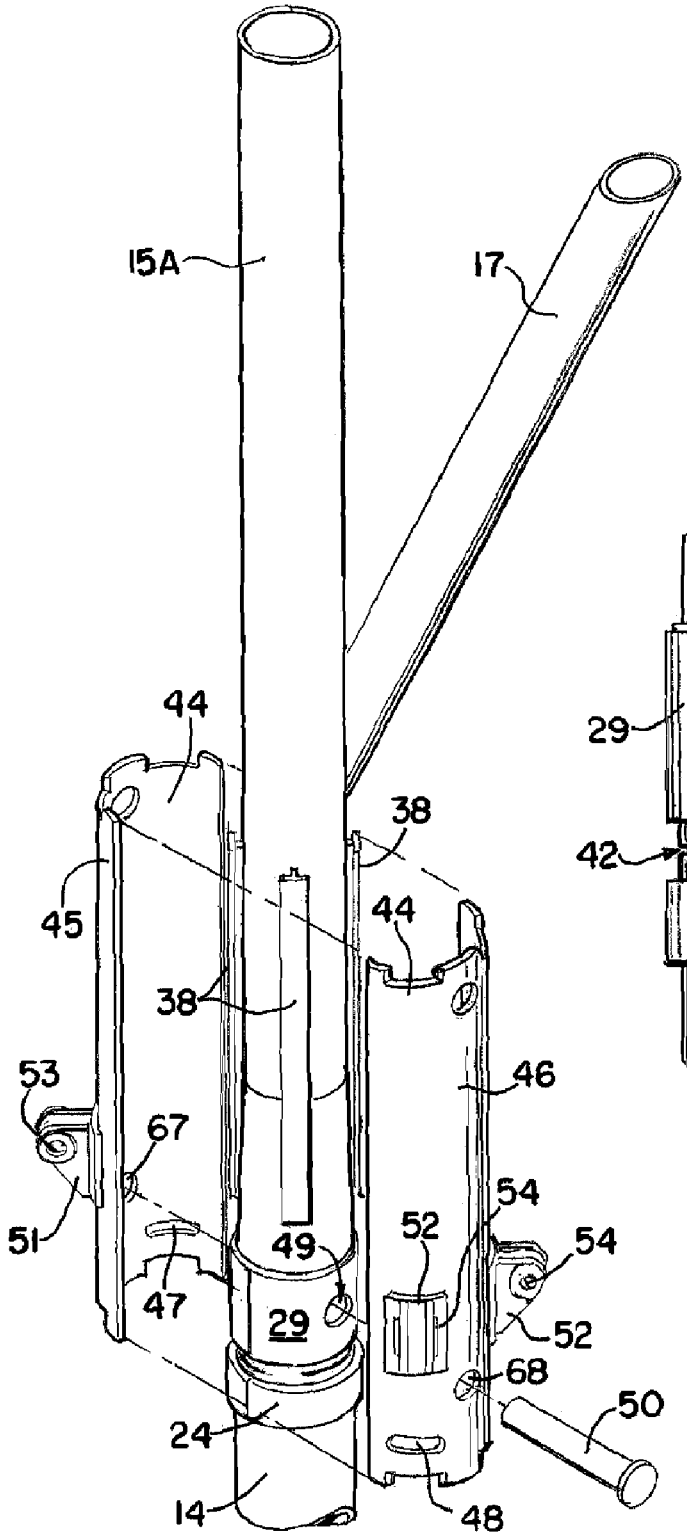
FIG. 11 is a partial perspective exploded view of the preferred embodiment of the apparatus of the present invention.

After the sleeve sections 45, 46 have been installed, a cut can be made to encircle the leg 14 thus severing it in two parts. In order to complete the cut, slots are provided in the sleeve sections 45, 46. In FIG. 11, the sleeve section 45 has slot 47. In FIG. 11, the sleeve section 46 has slot 48.

After installing the upper bushing sleeve 29, circular cut openings 49 are made through the leg 14 at the openings 35, 36 in the sleeve sections 27, 28. These cut openings 49 enable pin 50 to be placed through the openings 67, 68 in sleeve sections 45, 46 respectively as well as through the openings 49 in upper bushing sleeve 29. Pin 50 prevents uplift from damaging the platform 11 should a storm produce excess wave action before the method of the present invention can be completed.

Each of the sleeve sections 45, 46 provides lugs to which hydraulic pistons can be attached. Sleeve section 45 provides a plurality of lugs 51. Sleeve section 46 provides a plurality of lugs 52. Each of the lugs provides an opening for enabling a pinned connection to be made between the lugs 51, 52 and the hydraulic pistons 64. Lugs 51 provide openings 53. Lugs 52 provide openings 54. In the preferred method and apparatus, four pairs of lugs 51, 52 are thus provided to the extension sleeve 44. Each pair of lugs 51, 52 can be spaced circumferentially about sleeve 44, about 90 degrees apart.

Figure 12:
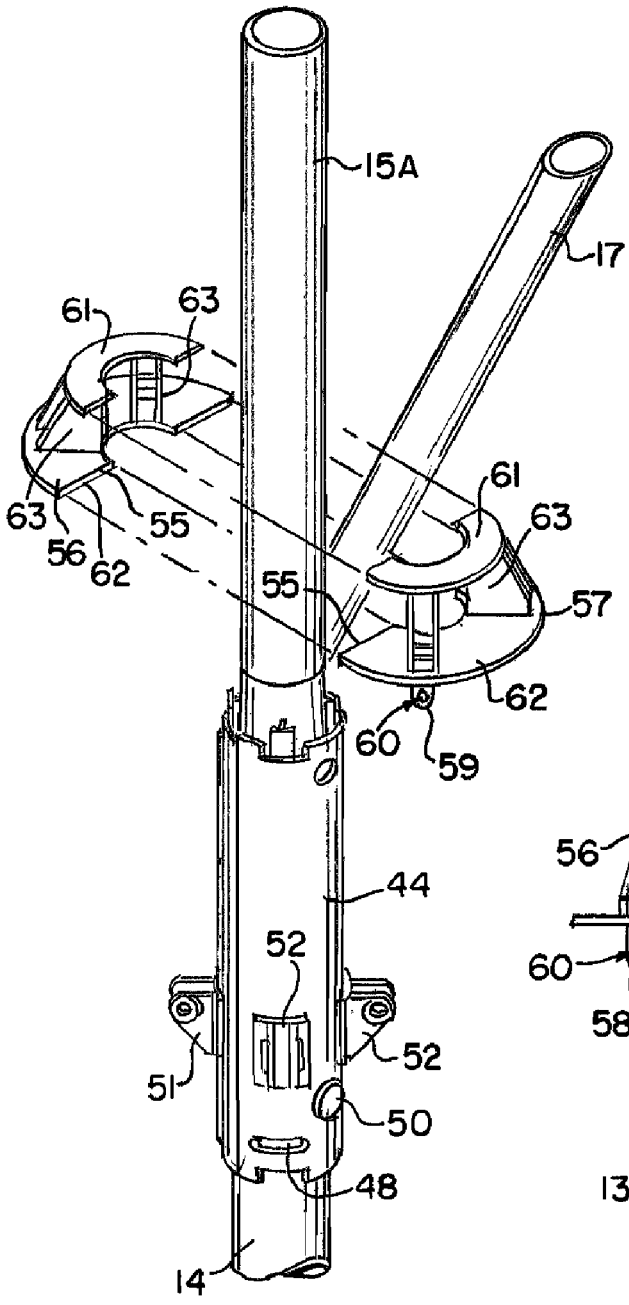
FIG. 12 is a partial perspective view of the preferred embodiment of the apparatus of the present invention illustrating the method of the present invention, placement of the upper ring.

A ring 55 is positioned above extension sleeve 44 as shown in FIGS. 12-15 and 17-19. Ring 55 is used to form a connection between the leg 14 and the hydraulic piston 64. Ring 55 can be formed of a pair of ring sections 56, 57 that are attached to the smaller diameter leg section 15A as shown in FIGS. 12 and 13. Each of the ring sections 56, 57 provides a plurality of lugs 58, 59. The ring section 56 has lugs 58. The ring section 57 has lugs 59. Each lug 58, 59 has a lug opening 60 that enables a pinned connection to be made between a lug 58 or 59 and a piston 64. Each ring section 56, 57 can be formed of arcuate generally horizontal plate sections and vertical plate sections. Each of the ring sections 56, 57 thus provide an upper arcuate plate section 61 and a lower arcuate plate section 62. Vertical plate sections 63 span between the upper and lower arcuate plate sections 61, 62.

Hydraulic pistons 64 are provided for elevating that portion of the leg 14 that is above the cuts that are made through the leg 14 (see FIGS. 10 and 16). Preferably three (3) or four (4) pistons can be used, but as few as two (2) rams can be used or more, such as many as eight (8) could be used for example.

Each hydraulic piston 64 can be comprised of a cylinder 65 and an extensible push rod 66. Each end portion of hydraulic piston 64 provides an opening 69 on cylinder 65 that enables a pinned connection to be formed between each end of hydraulic piston 64 and lugs 51, 52 or 58, 59. The upper end portion of each hydraulic piston 64 attaches with a pinned connection to a lug 58 or 59 that is a part of ring 55. The lower end portion of each hydraulic piston 64 forms a pinned connection with the lugs 51, 52 of extension sleeve 44 as shown in FIGS. 14-15. Arrows 74 in FIG. 14 illustrate assembly of pistons 64 to lugs 51, 52, 58, 59.

Once the hydraulic pistons 64 have been installed to the position shown in FIG. 15, a cut can be completed for severing leg 14. This can be seen in more detail in FIGS. 10, 15-16 wherein the previously formed cuts 42, 43 are shown. Notice that uncut portions 70 (DIM "B", FIG. 16) of leg 14 align with the slots 47 or 48 of sleeve sections 45, 46. The leg 14 can thus be cut 360 degrees by cutting the previously uncut section 70 at slot 47 or 48, indicated by phantom lines as cut 73 in FIG. 16. The three hundred sixty degree cut (42, 43, 73) is made after the extension sleeve 14, hydraulic pistons 64 and ring 55 form a structural support of the leg 14 above and below the cuts 42, 43. In order to then elevate the smaller diameter leg section 15A relative to the larger diameter leg section 15B below tapered section 13, each hydraulic piston 64 can be activated as illustrated by arrows 72 in FIG. 17.

Once elevated, the various openings and slots in sleeve 44 can be covered for corrosion protection using a plurality of curved cover plate sections 71. To complete the repair, the sleeves 44 can be welded to the leg 14 and using shims as necessary between sleeve 44 and leg 14, tapered section 13 or sections 15A, 15B. While the method disclosed herein contemplates that the elevation process would preferably take place as one jacking operation. The invention should not be so restricted. The method of the present invention contemplates a method wherein the jacking process could be subdivided into several smaller (or shorter) jacking elevations. The legs 14 would be pinned off at an intermediate point and the jacks moved to a second set of lugs. Arrow 75 in FIG. 17 shows the distance that the upper leg section 15A is elevated.

The following is a list of parts and materials suitable for use in the present invention.

PARTS LIST

| Part Number | Description |
|---|---|
| 10 | marine platform deck elevating system |
| 11 | platform |
| 12 | water surface |
| 13 | tapered section |
| 14 | leg |
| 15A | smaller diameter leg section |
| 15B | larger diameter leg section |
| 16 | deck |
| 17 | diagonal brace |
| 18 | existing deck elevation |
| 19 | existing clearance above water |
| 20 | new deck elevation |
| 21 | new clearance above water |
| 22 | sleeve section |
| 23 | sleeve section |
| 24 | lower bushing sleeve |
| 25 | arrow |
| 26 | weld |
| 27 | sleeve section |
| 28 | sleeve section |
| 29 | upper bushing sleeve |
| 30 | weld ring section |
| 31 | weld ring section |
| 32 | weld ring |
| 33 | arrow |
| 34 | arrow |
| 35 | opening |
| 36 | opening |
| 37 | weld |

-continued

| Part Number | Description |
|---|---|
| 38 | extension sleeve guide |
| 39 | arrow |
| 40 | flange |
| 41 | web |
| 42 | cut |
| 43 | cut |
| 44 | extension sleeve |
| 45 | extension sleeve section |
| 46 | extension sleeve section |
| 47 | slot |
| 48 | slot |
| 49 | drilled opening |
| 50 | support pin |
| 51 | lug |
| 52 | lug |
| 53 | opening |
| 54 | opening |
| 55 | ring |
| 56 | ring section |
| 57 | ring section |
| 58 | lug |
| 59 | lug |
| 60 | lug opening |
| 61 | upper arcuate plate section |
| 62 | lower arcuate plate section |
| 63 | vertical plate section |
| 64 | hydraulic piston |
| 65 | cylinder |
| 66 | pushrod |
| 67 | opening |
| 68 | opening |
| 69 | opening |
| 70 | uncut portion |
| 71 | cover plate |
| 72 | arrows |
| 73 | cut |
| 74 | arrow |
| 75 | arrow |

All measurements disclosed herein are at standard temperature and pressure, at sea level on Earth, unless indicated otherwise. All materials used or intended to be used in a human being are biocompatible, unless indicated otherwise.

The foregoing embodiments are presented by way of example only; the scope of the present invention is to be limited only by the following claims.

The invention claimed is:

1. A method of elevating a marine platform that is supported by a plurality of hollow metallic leg sections that extend above and below a water line of a body of water, said platform having a deck supported by the leg sections, comprising the steps of;

a) cutting one of the leg sections at a position next to the water line to provide a cut at a selected elevation;

b) attaching a sleeve to the leg section that was cut in step "a";

c) attaching a plurality of hydraulic rams to the leg sections, each ram having a hollowed cylinder and an extensible push rod and first and second end portions, the rams being attached to the leg section at the end portions, wherein each ram has a retracted and an extended position, wherein in the extended position, one end portion of each ram is attached to the leg section and not the deck above the cut and the other end portion being attached to the leg section below the cut;

d) repeating steps "a" through "b" for the other leg sections of the platform;

e) elevating the platforms by extending each ram to the extended position;

f) temporarily supporting the leg section above the cut with a pin that extends through aligned openings of the sleeve and leg section.

2. The method of claim 1 further comprising placing the rams on the outside of the leg section and circumferentially spacing the rams.

3. The method of claim 1 wherein in step "b" the sleeve is comprised of a plurality of sleeve sections and attaching the sleeve includes affixing the sleeve sections to the leg.

4. The method of claim 1 further comprising affixing lugs above and below the cut and attaching the rams to the leg sections at the lugs.

5. The method of claim 1 wherein the sleeve laterally stabilizes the leg sections above the cut during step "e".

6. The method of claim 1 wherein in step "c" there are at least three rams attached to each leg section.

7. The method of claim 1 wherein in step "c" there are between two (2) and eight (8) rams attached to each leg section.

8. The method of claim 1 wherein each leg section is elevated above the cut a distance of more than four feet.

9. The method of claim 1 wherein each leg section is elevated above the cut a distance of more than five feet.

10. The method of claim 1 wherein each leg section is elevated above the cut a distance of between about 5 and 30 feet.

11. The method of claim 1 wherein each leg section is a load of between 100 and 2,000 tons.

12. The method of claim 1 further comprising welding the sleeve to the leg sections after step "e".

13. The method of claim 1 further comprising reinforcing the leg section next to the pin with a section of curved plate welded to the leg section on its outer surface.

14. A method of elevating a marine platform that is supported by a plurality of hollow metallic leg sections that extend above and below a water line of a body of water, comprising the steps of;

a) cutting one of the leg sections at a position next to the water line to provide a cut at a selected elevation;

b) attaching a sleeve to the leg section that was cut in step "a";

c) attaching a plurality of hydraulic rams to the leg sections, each ram having a hollowed cylinder and an extensible push rod and first and second end portions, the rams being attached to the leg section at the end portions, wherein each ram has a retracted and an extended position, wherein in the extended position one end portion of each ram is attached to the leg section above the cut and the other end portion being attached to the leg section below the cut;

d) repeating steps "a" through "b" for the other leg sections of the platform;

e) elevating the platforms by extending each ram to the extended position;

f) temporarily supporting the leg section above the cut with a pin that extends through aligned openings of the sleeve and leg section.

15. The method of claim 14 further comprising placing the rams on the outside of the leg section and circumferentially spacing the rams.

16. The method of claim 14 wherein in step "b" the sleeve is comprised of a plurality of sleeve sections and attaching the sleeve includes affixing the sleeve sections to the leg.

17. The method of claim 14 further comprising affixing lugs above and below the cut and attaching the rams to the leg sections at the lugs.

18. The method of claim 14 wherein the sleeve laterally stabilizes the leg sections above the cut during step "e".

19. The method of claim 14 wherein in step "c" there are at least three rams attached to each leg section.

20. The method of claim 14 wherein in step "c" there are at least four rams attached to each leg section.

21. The method of claim 14 wherein each leg section is elevated above the cut a distance of more than four feet.

22. The method of claim 14 wherein each leg section is elevated above the cut a distance of more than five feet.

23. The method of claim 14 wherein each leg section is elevated above the cut a distance of between about 5 and 10 feet.

24. The method of claim 14 further comprising welding the sleeve to the leg sections after step "e".

25. The method of claim 14 further comprising reinforcing the leg section next to the pin with a section of curved plate welded to the leg section on its outer surface.

26. A method of elevating a marine platform that is supported by a plurality of hollow metallic leg sections that extend above and below a water line of a body of water, comprising the steps of;

a) attaching a sleeve to a leg section, the sleeve having a sleeve wall with one or more sleeve openings;

b) cutting one of the leg sections via a sleeve opening to provide a cut at a selected elevation;

c) attaching a plurality of jacking structures to the leg sections, each jacking structure having an extensible portion and first and second end portions, the jacking structure being attached to the leg section at the end portions, wherein each jacking structure has a retracted and an extended position, wherein in the extended position one end portion is attached to the leg section above the cut and the other end portion being attached to the sleeve below the cut, and wherein each jacking structure is movable between retracted and extended positions;

d) repeating steps "a" through "b" for the other leg sections of the platform;

e) elevating the platforms by extending each jacking structure to the extended position.

27. The method of claim 26 further comprising the step of attaching a sleeve to the leg.

28. The method of claim 27 wherein the sleeve is comprised of a plurality of sleeve sections and attaching the sleeve includes affixing the sleeve sections to the leg.

29. The method of claim 26 further comprising placing the jacking structures on the outside of the leg section.

30. The method of claim 26 further comprising affixing lugs above and below the cut and attaching the jacking structures to the leg sections at the lugs.

31. The method of claim 26 wherein the sleeve laterally stabilizes the leg sections above the cut during step "e".

32. The method of claim 26 wherein in step "b" there are at least three jacking structures attached to each leg section.

33. The method of claim 26 wherein in step "b" there are at least four jacking structures attached to each leg section.

34. The method of claim 26 wherein each leg section is elevated above the cut a distance of more than four feet.

35. The method of claim 26 wherein each leg section is elevated above the cut a distance of more than five feet.

36. The method of claim 26 wherein each leg section is elevated above the cut a distance of between about 5 and 10 feet.

37. The method of claim 26 further comprising welding the sleeve to the leg sections after step "e".

38. A method of elevating a marine platform that is supported by a plurality of hollow metallic leg sections that extend above and below a water line of a body of water, comprising the steps of;

a) attaching a sleeve to a leg section, the sleeve having a sleeve wall with one or more sleeve openings;

b) cutting one of the leg sections via a sleeve opening to provide a cut at a selected elevation;

c) attaching a plurality of jacking structures to the leg sections, each jacking structure having an extensible portion and first and second end portions, the jacking structure being attached to the leg section at the end portions, wherein each jacking structure has a retracted and an extended position, wherein in the extended position one end portion is attached to the leg section above the cut and the other end portion being attached to the sleeve below the cut;

d) repeating steps "a" through "b" for the other leg sections of the platform;

e) elevating the platforms by extending each jacking structure to the extended position;

f) temporarily supporting the leg section above the cut with a pin that extends through aligned openings of the sleeve and leg section.

39. The method of claim 38 further comprising reinforcing the leg section next to the pin with a section of curved plate welded to the leg section on its outer surface.

* * * * *